428-408 SR
PWE19 XR 4,145,472

United States Patent [19]
Spain et al.

[11] 4,145,472
[45] Mar. 20, 1979

[54] FIBROUS CARBONACEOUS MATERIAL SIZED WITH A GLYCIDYLHYDANTOIN SIZING

[75] Inventors: Raymond G. Spain, Huntington Beach; Albert L. Miller, Torrance, both of Calif.

[73] Assignee: HITCO, Irvine, Calif.

[21] Appl. No.: 830,845

[22] Filed: Sep. 6, 1977

[51] Int. Cl.[2] ..... D02G 3/00
[52] U.S. Cl. ..... 428/367; 427/394; 427/430 R; 427/434 D; 428/375; 428/392
[58] Field of Search ..... 428/367, 375, 378, 392, 428/364, 288, 289, 361; 252/8.8 N, 8.8 AG; 427/430 B, 430 R, 434 D, 384, 394

[56] References Cited

U.S. PATENT DOCUMENTS

| | | | |
|---|---|---|---|
| 3,671,285 | 6/1972 | Prescott | 428/367 |
| 3,676,200 | 7/1972 | Rembold et al. | 428/367 X |
| 3,770,539 | 11/1973 | Bullock | 428/367 X |
| 3,837,904 | 9/1974 | Hill | 428/367 X |
| 3,914,504 | 10/1975 | Weldy | 428/367 |
| 3,957,716 | 5/1976 | Weldy | 260/37 EP |
| 4,043,074 | 8/1977 | Airhart | 428/367 X |

*Primary Examiner*—Lorraine T. Kendell
*Attorney, Agent, or Firm*—Fraser and Bogucki

[57] ABSTRACT

A water soluble sizing for fibrous carbonaceous material consists of either 1,3-diglycidyl-5,5-dimethylhydantoin or 1,3-diglycidylhydantoin. The carbonaceous material is sized by immersion in an aqueous solution of the sizing having a concentration of 0.1–10%, preferably 1–2%, by weight, followed by drying. In addition to being highly water soluble, non-toxic and non-flammable, the sizing provides excellent filament control so as to minimize fuzzing during subsequent handling of the carbonaceous material and is compatible with an epoxy resin matrix system.

12 Claims, No Drawings

FIBROUS CARBONACEOUS MATERIAL SIZED WITH A GLYCIDYLHYDANTOIN SIZING

BACKGROUND OF THE INVENTION

1. Field of the Invention

The present invention relates to sizings for fibrous materials, and more particularly to sizings applied to carbonaceous fibers to facilitate handling and processing thereof following carbonization.

2. History of the Prior Art

It is known to provide fibrous material with a sizing to facilitate handling and processing of the material. Sizings are particularly useful in the case of materials such as carbon fibers where filamentary structures of the fibers are difficult to control. As a result when such fibers are processed without application of a sizing they tend to fuzz and may actually separate or break as they are pulled over pulleys, rollers and the like in automatic processing equipment. Examples of sizings used with carbon fibers are provided by U.S. Pat. No. 3,914,504 and 3,957,716 which disclose the use of polyglycidyl ethers, cycloaliphatic polyepoxides and mixtures thereof, and U.S. Pat. No. 3,837,904 which discloses the use of epoxy, polyimide, polyamide and polyester resins.

Fuzzing and other problems inherent in the handling and processing of carbon fibers can be greatly minimized or eliminated by application of an appropriate sizing. At the same time, however, the sizing must be such that it does not significantly degrade the properties of composites made by combining the carbon fibers with a resin system, both at room temperature and at elevated temperatures as high as 350° F. In addition, the sizing should be reasonably easy to apply to the fibers and without the need for the type of equipment and precautions necessitated by highly flammable or toxic materials. Problems of flammability and toxicity are frequently present when using sizings which require an organic solvent such as diacetone alcohol. Such sizings must be applied in a carefully controlled and ventilated environment to prevent health problems. Where automatic processing equipment is used in the sizing operation, such equipment must use explosion-proof motors and otherwise be free of sparks or flames which may ignite the sizing material or vapors therefrom. There is a further problem of eventual recovery and disposal or reuse of highly flammable or toxic or expensive solvent materials of this type.

In an attempt to avoid the problems caused by the flammable or toxic nature of many organic solvents, various emulsions have been used as sizings. Sizings of this type have included aqueous emulsions of epoxy resins. While such materials do not involve the severe problems of toxicity and flammability present with certain other materials, still they are disadvantageous in a number of respects. Such materials require that an emulsion be made using emulsifying agents which may be relatively expensive. Such materials, moreover, may provide less than the desired degree of filament control and may seriously degrade the properties of composites ultimately made from the carbon fibers being sized.

Accordingly, it is an object of the invention to provide a sizing for fibrous carbonaceous material which is easily applied to the material and without attendant hazards such as may be due to high toxicity or flammability.

It is a further object of the invention to provide a sizing for fibrous carbonaceous material which is applied to the material easily and without the need for organic solvents, emulsifying agents and the like.

It is a still further object of the invention to provide a sizing for fibrous carbonaceous material which is easily and safely applied to the material and which does not significantly degrade the properties of composite materials ultimately made from the carbonaceous material measured at both room temperature and elevated temperatures.

BRIEF DESCRIPTION OF THE INVENTION

Sizings in accordance with the invention for use with fibrous carbonaceous material are water soluble, nontoxic and non-flammable, making the application thereof simple and inexpensive. Once applied, the sizing provides filament control to prevent fuzzing or other deleterious effects upon handling and processing of the fibrous material. In the event the fibrous material is combined with a resin system to form a composite, the resulting properties of the composite are not significantly affected by the presence of the sizing on the fibrous material.

The sizing preferably consists of 1,3-diglycidyl-5,5-dimethylhydantoin or 1,3-diglycidylhydantoin. Such compounds are highly soluble in water and are dissolved in water to form an aqueous solution in which the fibrous carbonaceous material to be sized is immersed. The solution has a concentration by weight of 0.1–10%, preferably 1–2%, and deposits a size on the fibrous material typically comprising about 0.1–2% by weight of the material. After immersion, the fibrous carbonaceous material is dried such as by blowing hot air thereon in an oven. The material may then be handled or processed without fear of fuzzing or other filament control problems. Ultimately, the material may be formed into a composite by impregnating with an epoxy resin, forming into a laminate and curing the resin.

DETAILED DESCRIPTION

Sizings in accordance with the invention have the chemical formula:

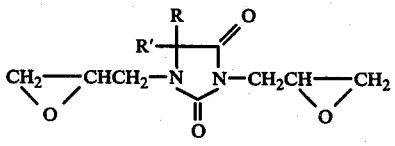

where R and R′ consist of H, $CH_3$ or any other low alkyl groups which will result in a water soluble compound. While R and R′ are typically the same, they need not be. Where R and R′ are hydrogen (H) the compound becomes 1,3-diglycidylhydantoin. In other cases, the compound is 1,3-diglycidyl-5,5-dimethylhydantoin (or 1,3 diglycidyl-5-methylhydantoin).

One compound which has been found particularly suitable as a sizing in accordance with the invention is sold under the designation XB-2793 by Ciba-Geigy Company. This compound is a condensation product of 5,5-dimethylhydantoin which has the formula:

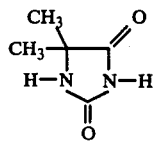

and epichlorohydrin which has the formula:

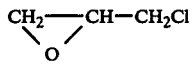

The resulting condensation product which is 1,3-diglycidyl-5,5-dimethylhydantoin has the formula:

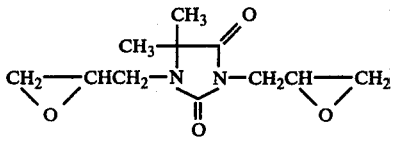

Sizing compounds of the type described are applied to carbon fibers and other carbonaceous materials as a sizing by first forming an aqueous solution of proper concentration. This is accomplished by dissolving the compound in water to a concentration by weight of 0.1–10% and preferably 1–2%. The carbon fibers are then immersed in the aqueous solution such as by use of a dip tank in conjunction with automatic processing equipment for continuously running the carbon fibers through the dip tank. The fibers are immersed in the aqueous solution long enough to provide thorough wetting of the fibers. Compounds of the type described above have advantageous wetting properties when formed into an aqueous solution having the desired concentration, such that a residence time of a few seconds is all that is necessary to effect thorough wetting of the carbon fibers.

Upon the removal of the carbon fibers from the dip tank, the fibers are next dried so as to remove the water from the wetted fibers. This can be done in air or in other appropriate arrangements such as by running the carbon fibers from the dip tank into an oven where the fibers are preferably retained for several minutes. Within the oven air heated to an elevated temperature typically in excess of the boiling temperature of water is blown onto the fibers.

When drying of the fibers is completed, the fibers as protected by the sizing coated thereon can be handled or processed without significant fuzzing or other deleterious effects. Thus, the fibers may be run through automatic processing equipment which utilizes rollers, pulleys and similar devices to guide the fibers without danger of fraying or breakage of the fibers.

The sizing coated on the fibers typically comprise 0.10% up to a maximum of about 10% of the weight of the fibers, depending upon the concentration of the aqueous solution and the extent of fiber wetting during immersion in the dip tank. For 100% wetting, the weight percentage of the size on the fibers is theoretically the same as the concentration by weight of the size in the aqueous solution. As a practical matter, however, the weight percentage of size on the fibers is usually somewhat less than the concentration by weight of the size in the aqueous solution. Thus for a 2% solution, the weight percentage of the size on the fibers is typically about 1–1.5%. Carbon fibers sized in a 0.20% by weight aqueous solution of 1,3-diglycidyl-5,5-dimethylhydantoin were tested by extraction with an azeotropic mixture of ethanol and 1,1,1-trichloroethane, and were determined to have a size loading of 0.12% by weight. The same fibers run through an aqueous solution of the same sizing but having a concentration of 0.29% by weight were determined to have a size loading of 0.19% by weight. Raising the concentration of the aqueous solution to 0.5% produced fibers having a size loading of 0.30% by weight.

It will be appreciated by those skilled in the art that sizings in accordance with the invention are easily and economically applied to fibrous carbonaceous material. Water constitutes a solvent which is not only very inexpensive when compared with organic solvents and emulsifying agents but which is also easily removed from the sized fibers without the need for a recovery system. Moreover, water is safe and harmless and does not require special ventilating equipment as do many of the solvents of the prior art. Finally, water is nonflammable and does not pose a flammability or explosion problem as do many of the organic solvents used in the prior art.

As previously noted the sizing is desirably compatible with an epoxy resin matrix system so that the sized carbon fibers can be impregnated with such a resin system and the resin system thereafter cured to form a composite having suitable properties, particularly flexural strength, flexural modulus and interlaminar shear strength. It has been found that sizing carbon fibers with the sizing compounds according to the invention results in composites with physical properties that are affected very little if at all by the presence of the size.

In a typical process for making a composite from sized carbon fibers, the sized fibers which appear in tow, cloth or other appropriate form are impregnated with an epoxy resin and placed in a mold or otherwise in an appropriate configuration prior to curing the resin. The curing process may vary, but typically involves heating the impregnated fibers from room temperature to about 275° F. at a rate of about 5° F. per minute in an autoclave. Thereafter the composite is maintained at 275° F. for about 30 minutes, following which elevated pressure on the order of 100 psi may be applied, as desired. The composite is then heated to about 300° F. for about 15 minutes, following which an elevated pressure of about 100 psi is applied if it was not applied previously. The composite is then heated to about 350° F. where it is maintained at that temperature for about two hours. Thereafter the composite is cooled under pressure to about 200° F. and is removed from the autoclave. Depending upon the resin an optional post cure step of heating to about 400° F. for about two hours may be employed.

EXAMPLE I

Carbon fibers comprising a 2000 filament tow were sized using a 1% aqueous solution of the compound sold under the designation XB-2793 by Ciba-Geigy Company. After drying, the sized fibers were impregnated with an epoxy resin sold under the designation ERLA-4617 by Union Carbide Corporation, formed into a laminate and the resin was cured using the process described above. The flexural strength, flexural modulus and interlaminar shear strength of the resulting composite at room temperature and at two different elevated temperatures were determined to be as follows:

| | Room Temp. | 180° F. | 350° F. |
|---|---|---|---|
| Flexural Strength (ksi) | 199.8 | 189.9 | 82.5 |
| Flexural Modulus (msi) | 17.9 | 18.5 | 12.4 |
| Shear Strength (ksi) | 16.8 | 13.2 | 5.3 |
| 1 ksi = $1 \times 10^3$ lb./in.$^2$ | | | |
| 1 msi = $1 \times 10^6$ lb./in.$^2$ | | | |

EXAMPLE II

Carbon fibers made from a 160,000 filament acrylic textile tow were sized using the same aqueous solution as in Example I and were impregnated with Union Carbide ERLA-4617 epoxy resin and cured. The resulting composite was determined to have the following properties at room temperature and at four different elevated temperatures:

| | Room Temp. | 180° F. | 250° F. | 300° F. | 350° F. |
|---|---|---|---|---|---|
| Flexural Strength (ksi) | 116.6 | 124.0 | 130.3 | 110.7 | 54.5 |
| Flexural Modulus (msi) | 12.1 | 12.1 | 10.8 | 9.5 | 6.9 |
| Shear Strength (ksi) | 15.4 | 14.2 | 10.3 | 6.5 | 5.5 |

EXAMPLE III

Further samples of the 160,000 filament acrylic textile tow sized using the same aqueous solution as in Example I were impregnated with an epoxy resin formed from a mixture of Dow Chemical Company DER-331, Dow Chemical Company DER-661, Ciba-Geigy Company EPORAL, and acetone, and formed into a laminate. The resin was then cured, and the resulting composite was determined to have the following properties:

| | Room Temp. | 180° F. | 250° F. | 300° F. | 350° F. |
|---|---|---|---|---|---|
| Flexural Strength (ksi) | 118.3 | 124.0 | 122.0 | 59.2 | 26.6 |
| Flexural Modulus (msi) | 11.2 | 11.9 | 10.8 | 9.5 | 4.4 |
| Shear Strength (ksi) | 13.8 | 10.0 | 7.1 | 3.0 | 3.2 |

EXAMPLE IV

Further samples of the 160,000 filament acrylic textile tow were sized using the same aqueous solution as in Example I and were impregnated with epoxy resin sold under the designation C-143 K by Young Lee Associates, with the tow being formed into a laminate and the resin system being cured. The resulting composite was determined to have the following properties:

| | Room Temp. | 180° F. | 350° F. |
|---|---|---|---|
| Flexural Strength (ksi) | 107.8 | 74.7 | 19.9 |
| Flexural Modulus (msi) | 10.1 | 9.0 | 4.9 |
| Shear Strength (ksi) | 9.3 | 3.0 | 1.6 |

EXAMPLE V

Carbon fibers made from a different 160,000 filament acrylic textile tow were sized using the same aqueous solution as in Example I and were impregnated with an epoxy resin comprising a mixture of Dow Chemical Company DEN-438, Union Carbide Corporation Bakelite phenoxy resin PKHH, Ciba-Geigy Company EPORAL, and acetone. Thereafter, the fibers were formed into a laminate, the resin was cured, and the composite was determined to have the following properties:

| | Room Temp. | 250° F. | 350° F. |
|---|---|---|---|
| Flexural Strength (ksi) | 187.8 | 182.7 | 156.9 |
| Flexural Modulus (msi) | 16.4 | 16.1 | 15.8 |
| Shear Strength (ksi) | 14.7 | 10.2 | 7.5 |

The thermal capabilities of the matrix resins are not degraded by the presence of the sizing and in the above examples are approximately as follows:

| | |
|---|---|
| Example I | 300–325° F. |
| Example II | 300–325° F. |
| Example III | 250° F. |
| Example IV | 150–175° F. |
| Example V | 350° F. |

It will be appreciated by those skilled in the art that the various physical properties of composites made from fibrous materials sized in accordance with the invention are comparable with the properties of unsized fibers and are characteristic of the matrix resin employed, and in any event exceed the minimum requirements imposed by most aircraft and aerospace manufacturers for such composite materials.

While the invention has been particularly described with reference to preferred examples thereof, it will be understood by those skilled in the art that various changes in form and details may be made therein without departing from the spirit and scope of the invention.

What is claimed is:

1. Carbon fibers having a water soluble sizing thereon consisting of 1,3-diglycidyl-5,5-dimethylhydantoin.

2. The invention set forth in claim 1, wherein the sizing comprises 0.1–2% by weight of the fibers.

3. The invention set forth in claim 1, further comprising an at least partially cured epoxy resin forming a composite with the carbon fibers.

4. Fibrous carbonaceous material having a water soluble sizing thereon having the formula:

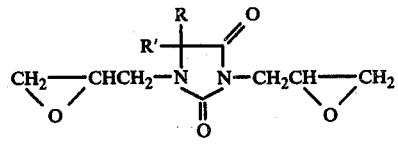

where R and R′ are selected from low alkyl groups.

5. The invention set forth in claim 4, wherein the sizing consists of 1,3-diglycidyl-5,5-dimethylhydantoin.

6. The invention set forth in claim 4, wherein the sizing consists of 1,3-diglycidylhydantoin.

7. The invention set forth in claim 4, wherein the sizing consists of 1,3-diglycidyl-5-methylhydantoin.

8. In a method of treating fibrous carbonaceous material to facilitate filament control during processing of the material in which the material is immersed in an aqueous solution of a sizing and thereafter dried, the improvement consisting of using a sizing having the formula:

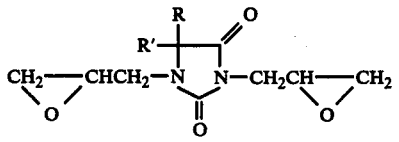

where R and R′ are selected from the group consisting of H and $CH_3$.

9. The invention set forth in claim 8, wherein the step of drying the material is carried out by exposing the material to heated air in an oven.

10. The invention set forth in claim 8, wherein the aqueous solution has a concentration of 0.1–10% by weight.

11. The invention set forth in claim 8, wherein the sizing consists of 1,3-diglycidyl-5,5-dimethylhydantoin.

12. The invention set forth in claim 8 comprising the further steps of processing the fibrous carbonaceous material following drying thereof, impregnating the material with epoxy resin, forming the material into a laminate and at least partially curing the resin to form a composite.

* * * * *